US009604746B2

(12) United States Patent
Barel et al.

(10) Patent No.: US 9,604,746 B2
(45) Date of Patent: Mar. 28, 2017

(54) BOTTLE MADE OF POLYMER MATERIAL

(71) Applicant: PET ENGINEERING S.R.L., San Vendemaino (Treviso) (IT)

(72) Inventors: Moreno Barel, Refrontolo (IT); Alessandro Bortoluzzi, Mareno di Piave (IT); Nicola Brugnera, Visna di Vazzola (IT)

(73) Assignee: PET ENGINEERING S.R.L., San Vendemiano (Treviso) (IT)

( * ) Notice: Subject to any disclaimer, the term of this patent is extended or adjusted under 35 U.S.C. 154(b) by 0 days.

(21) Appl. No.: 14/370,364

(22) PCT Filed: Apr. 24, 2013

(86) PCT No.: PCT/IB2013/053244

§ 371 (c)(1),
(2) Date: Jul. 2, 2014

(87) PCT Pub. No.: WO2013/164736

PCT Pub. Date: Nov. 7, 2013

(65) Prior Publication Data

US 2015/0034660 A1 Feb. 5, 2015

(30) Foreign Application Priority Data

May 4, 2012 (IT) ..... TV2012A0071

(51) Int. Cl.
*B65D 1/02* (2006.01)
*B65D 1/44* (2006.01)

(52) U.S. Cl.
CPC ..... *B65D 1/0284* (2013.01); *B65D 1/44* (2013.01)

(58) Field of Classification Search
CPC ..... B65D 1/0284; B65D 1/44; B65D 1/00; B65D 1/02; B65D 1/0223; B65D 1/0261; B65D 1/40; B65D 1/42; B65D 1/46
(Continued)

(56) References Cited

U.S. PATENT DOCUMENTS 4,134,510 A * 1/1979 Chang ..... B29C 49/541 215/373
4,174,782 A * 11/1979 Obsomer ..... B65D 1/0276 215/373

(Continued)

FOREIGN PATENT DOCUMENTS

CN 1852837 A 1/2006
CN 101522531 A 9/2009

(Continued)

OTHER PUBLICATIONS

PCT International Search Report and Written Opinion for PCT/IB2013/053244, from which the instant application is based, 7 pgs.

*Primary Examiner* — Steven A. Reynolds
*Assistant Examiner* — Javier A Pagan
(74) *Attorney, Agent, or Firm* — Fredrikson & Byron, P.A.

(57) ABSTRACT

A bottle made of polymer material includes a base provided with a plurality of ribs. Each rib is composed of a curvature of the base of the bottle which forms a protuberance in the longitudinal direction directed towards the inside of the bottle. The ribs extend in a radial direction along a line of radial extension. The bottle is characterized in that the projection, in a transverse plane, of the line of radial extension of at least one of said ribs is curved.

12 Claims, 6 Drawing Sheets

(58) Field of Classification Search
USPC ..... 220/608
See application file for complete search history.

(56) References Cited

U.S. PATENT DOCUMENTS

| | | | | | |
|---|---|---|---|---|---|
| 4,249,666 | A * | 2/1981 | Hubert | B65D 1/0276 | 215/373 |
| 4,598,831 | A * | 7/1986 | Nakamura | B65D 1/0276 | 215/373 |
| 4,818,575 | A * | 4/1989 | Hirata | B29C 49/22 | 215/12.2 |
| 4,863,046 | A * | 9/1989 | Collette | B29C 49/0073 | 215/381 |
| 4,993,566 | A * | 2/1991 | Eberle | B29C 49/48 | 215/373 |
| 4,993,567 | A * | 2/1991 | Eberle, Jr. | B29C 49/48 | 215/373 |
| 5,217,737 | A * | 6/1993 | Gygax | B65D 1/0215 | 215/373 |
| 5,234,126 | A * | 8/1993 | Jonas | B65D 1/165 | 215/373 |
| 5,503,283 | A * | 4/1996 | Semersky | B65D 1/0276 | 215/375 |
| 5,785,197 | A * | 7/1998 | Slat | B65D 1/0284 | 215/373 |
| 6,059,139 | A * | 5/2000 | Landreneau | B65D 1/0261 | 215/375 |
| 6,065,624 | A * | 5/2000 | Steinke | B65D 1/0276 | 215/373 |
| D428,814 | S * | 8/2000 | Silvers | D9/502 | |
| 6,409,035 | B1 * | 6/2002 | Darr | B65D 1/0276 | 215/373 |
| 6,595,380 | B2 * | 7/2003 | Silvers | B65D 79/005 | 215/373 |
| 6,634,517 | B2 * | 10/2003 | Cheng | B65D 1/0276 | 215/371 |
| D547,651 | S * | 7/2007 | Simpson, Jr. | D9/434 | |
| 7,416,088 | B2 * | 8/2008 | Boukobza | B65D 1/0276 | 215/371 |
| 7,416,089 | B2 * | 8/2008 | Kraft | B65D 1/0276 | 215/373 |
| 7,780,025 | B2 * | 8/2010 | Simpson, Jr. | B67C 3/045 | 215/376 |

FOREIGN PATENT DOCUMENTS

| | | | |
|---|---|---|---|
| CN | 101633417 | A | 1/2010 |
| CN | 101939226 | A | 1/2011 |
| JP | 61144012 | U | 9/1986 |
| JP | 6228335 | A | 2/1987 |

* cited by examiner

BOTTLE MADE OF POLYMER MATERIAL

RELATED APPLICATIONS

This application is a 35 U.S.C. 371 national stage filing from International Application No. PCT/IB2013/053244 filed Apr. 24, 2013 and claims priority to Italian Application No. TV2012A000071 filed May 4, 2012, the teachings of which are incorporated herein by reference.

FIELD OF THE INVENTION

The present invention relates to a bottle made of polymer material.

In particular the present invention relates to bottles made of PET (polyethylene terephthalate), it being understood that it is possible to apply the principles of the present invention also to other types of materials such as PLA (polylactide), OPP (oriented polypropylene), PEN (polyethylene naphthalate), etc.

BACKGROUND

Usually these bottles are made from a cylindrical preform which, after suitable heating, is introduced into a mould and subjected in succession to stretching and blowing steps.

In PET bottle filling processes, the bottles which have not yet been filled must have a form such as to withstand the stresses due to the movement along the entire production line. Subsequently, when they are filled, they must be able to withstand the stresses arising during the palletization and transportation operations.

For this reason, the bottles are designed with geometric shapes such as to ensure the best possible mechanical performance and avoid excessive deformation.

However, the mechanical performance is not the only factor which must be taken into consideration.

Should the shape of the bottle, in order to achieve a satisfactory mechanical strength, be very complex, the associated production process might not be sufficiently simple. In particular, the parison blowing operation might not be able to ensure an adequate degree of reproducibility of the bottle, in particular in the region of the base.

In other words, a bottle with a geometric shape which is highly resistant to mechanical stresses could be too complicated to produce by means of the stretching and blowing process. Therefore, the experience of the polymer bottles designer, attempts to achieve a suitable compromise between rigidity of the container due to the geometry, empty weight of the bottle (i.e. quantity of material to be distributed in the stretching and blowing process) and "blowability" of the container, understood as meaning the capacity for reproducing a given form while maintaining a more or less constant thickness of the material throughout the bottle.

Moreover, manufacturers tend to gradually reduce the weight of the bottles with the aim of achieving a saving in material costs and a reduction in the environmental impact.

In the case of water containers, the low value of the contents of the bottle make it even more desirable to achieve a reduction in weight of the container. This has resulted in increasingly smaller wall thicknesses down to minimum thickness values of the polymer material forming the bottle ranging between 0.05 and 0.3 mm.

When the bottle is filled with liquid such as water a problem arises in connection with handling thereof, namely compression of the walls in the radial direction and axial direction, which compression is even more pronounced when there is a reduction in the thickness of the walls.

In order to make the bottle stronger and more resistant to the aforementioned deformations, one solution which has been proposed and implemented is that of adding nitrogen in the liquid state to the contents of the bottle inside the space at the top of the container immediately after the filling step and just before the capping step. The nitrogen evaporates and expands inside the empty space between the liquid and the cap. The bottle is thus pressurised and is able to withstand greater axial and radial load stresses than a bottle without nitrogen.

This technology is applied in particular when filling, with water or other liquids which have not been added with gas, bottles having a weight which is very light and unable to ensure per se an adequate mechanical performance.

Pressurisation of the bottle, however, creates stresses in some cases such that they deform excessively the bottle and in particular its base which, if not sufficiently strong, may flex or bow outwardly.

Outward flexing of the base results in the instability of the bottle which does not rest over its normal supporting area, but on the central point of the base, making the bottle unstable with the evident problems in terms of both transportation and use and handling by the end user.

At the state of the art there exist other methods of pressurisation which are implemented using mixed sterile compressed air or carbon dioxide used in the case of gaseous beverages. In the case of these applications, also, the improvements and problems are similar to those encountered when performing filling with nitrogen.

Therefore, the prior art, although widely established, is not without drawbacks.

In fact, hitherto the geometry of the bottle base has been designed to optimize the structural resistance to high internal pressures, using the conventional solution of increasing the rigidity of the base by means of ribs, the centre of which, projected along the supporting surface, has a radial progression. In this connection, FIG. 1 shows the base of a bottle according to the prior art. The term "rib" is understood as meaning a curvature of the base of the bottle which forms a protuberance in the longitudinal direction, directed towards the inside of the bottle, so that they appear to the observer as recesses.

Moreover, in order to increase the resistance to stresses due to pressurisation with nitrogen or other pressurisation systems, it has been attempted to increase the number and depth of the radial ribs, without however achieving the expected success both for structural reasons and in particular because the moulding operation is very complex.

The internal pressure tends to deform the base, causing it to assume a form which resembles most closely (at the theoretical limit values) the form of a semi-sphere. The line of extension of the conventional rib would therefore tend to assume the form of a cord lying on a sphere and joining the outermost point of the base with the central point of the base.

In the conventional solutions the internal pressure tends to deform the base which withstands in the inertia cross-section perpendicular to the radial direction only moments contained in radial planes comprising the longitudinal axis of the bottle.

BRIEF SUMMARY OF EMBODIMENTS OF THE INVENTION

The object of the present invention is therefore to overcome the drawbacks of the prior art.

A first task of the present invention is to provide a bottle which is very light and the base of which flexes outwardly very slightly, i.e. by an amount such as to ensure stable positioning of the bottle both when empty and when full.

A second task is to ensure that the bottle with the above characteristics can also be easily produced by means of the normal parison blow-moulding method.

The object and the abovementioned tasks are achieved with a bottle according to claim 1.

The object of the present invention is a bottle made of polymer material comprising a base. On the base of the bottle a plurality of ribs is provided, each of which projects in the longitudinal direction towards the inside of the bottle. Each rib extends along a line of radial extension. The bottle is characterized in that the projection in a transverse plane of the line of radial extension of at least one of said ribs is curved.

This special geometric form of the base permits to increase the rigidity of the surface with a limited number of ribs. The rigidity of the rib, in fact, extends along a length greater than that of a radial rib since it has a greater extension between the outer diameter of the bottle and the centre of the base.

In the case of a conventional base, the length of the projection of the rib in a transverse plane is at the most equal the external radius of the bottle. In the base of the present invention the length is greater since the line of radial extension has spatially a curvilinear and not a rectilinear progression with the same point of departure and arrival, compared to a rib having a line of radial extension coinciding with a radius of the bottle.

BRIEF DESCRIPTIONS OF DRAWINGS

The characteristic features and advantages of the bottle achieved by applying the principles of the present invention will emerge more clearly from the description below of a number of examples of embodiment, provided by way of a non-limiting example, with reference to the accompanying drawings in which.

DETAILED DESCRIPTION OF EMBODIMENTS OF THE INVENTION

Figure 1:
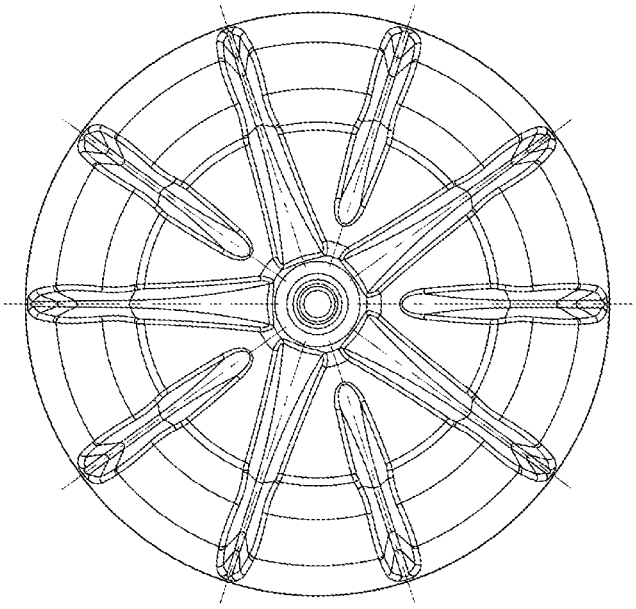
FIG. 1 shows a plan view, from below, of a base of a bottle according to the prior art.
Figure 2:
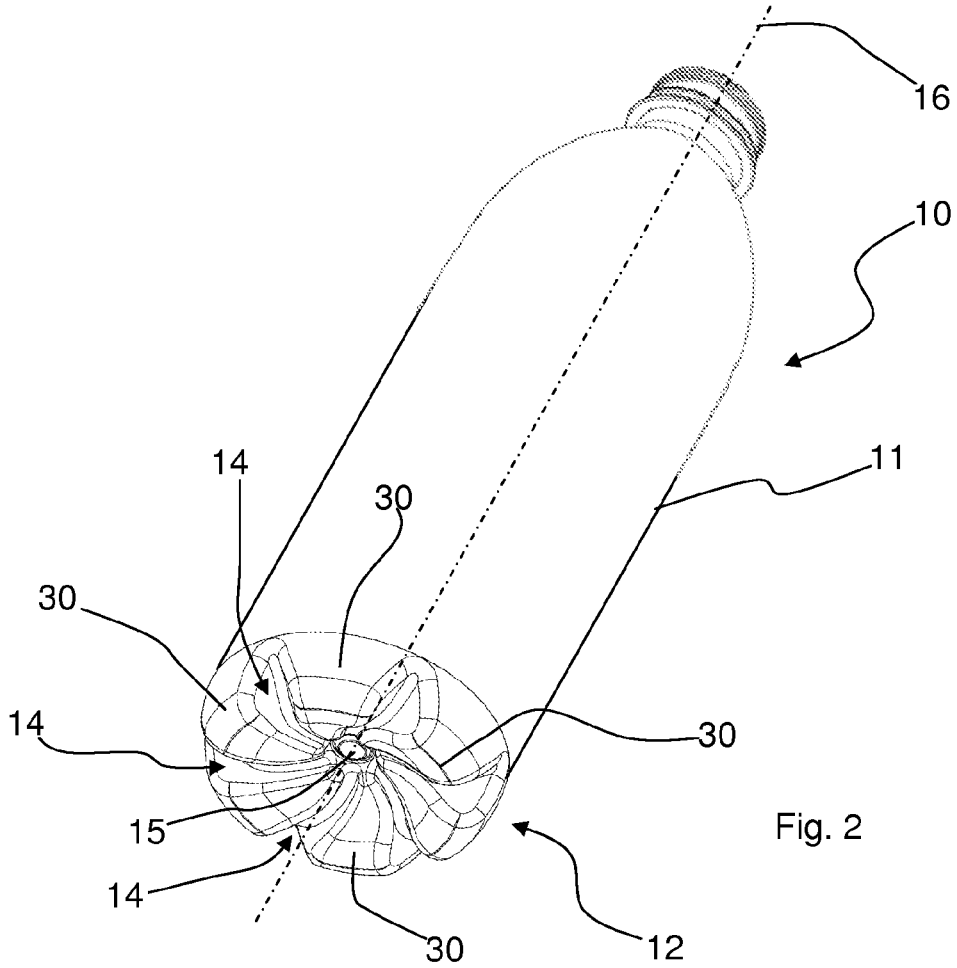
FIG. 2 shows a perspective view, from below, of a bottle according to the present invention.

FIG. 2 shows a bottle 10 made of polymer material comprising a base 12. On the base 12 of the bottle a plurality of ribs 14 is provided, each of which is composed of a curvature of the base 12 of the bottle 10 which forms a protuberance in the longitudinal direction towards the inside of the bottle 10.

With reference still to FIG. 2 the following are defined:

- a longitudinal direction, any direction parallel to the direction of the longitudinal axis of the bottle (indicated by the reference number 16) which joins the inlet mouth to the base of the bottle;
- a transverse plane, any plane perpendicular to the longitudinal direction;
- a longitudinal plane, any plane comprising the longitudinal axis of the bottle; and
- a radial direction, any direction lying in a transverse plane passing through the longitudinal axis of the bottle.

Figure 3:
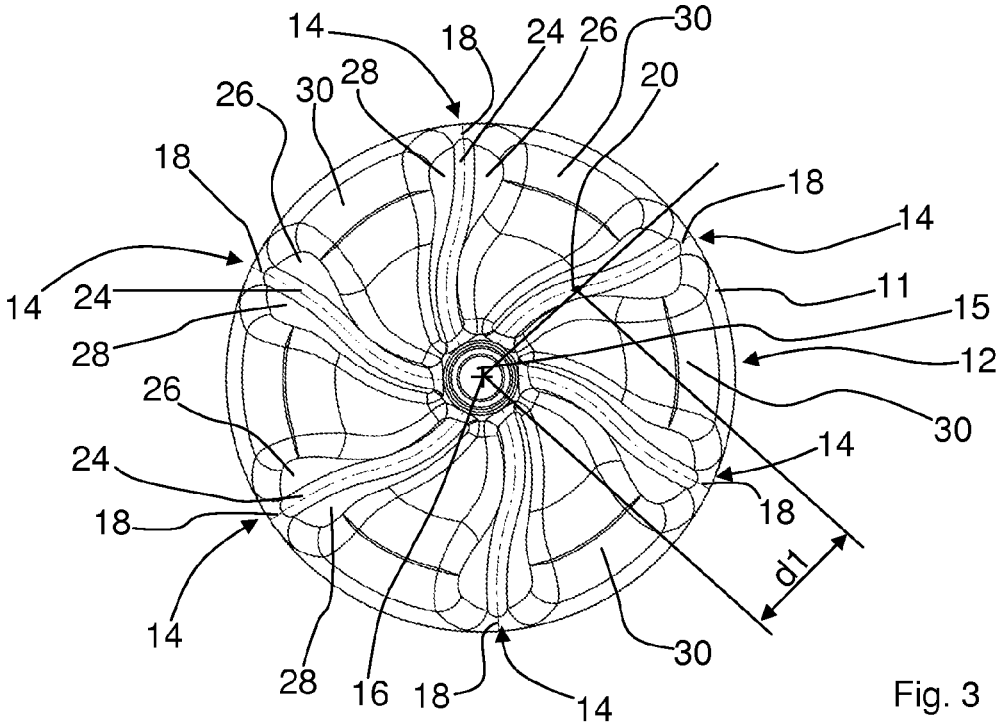
FIG. 3 shows a plan view, from below, of the base of a bottle according to the present invention.
Figure 4:
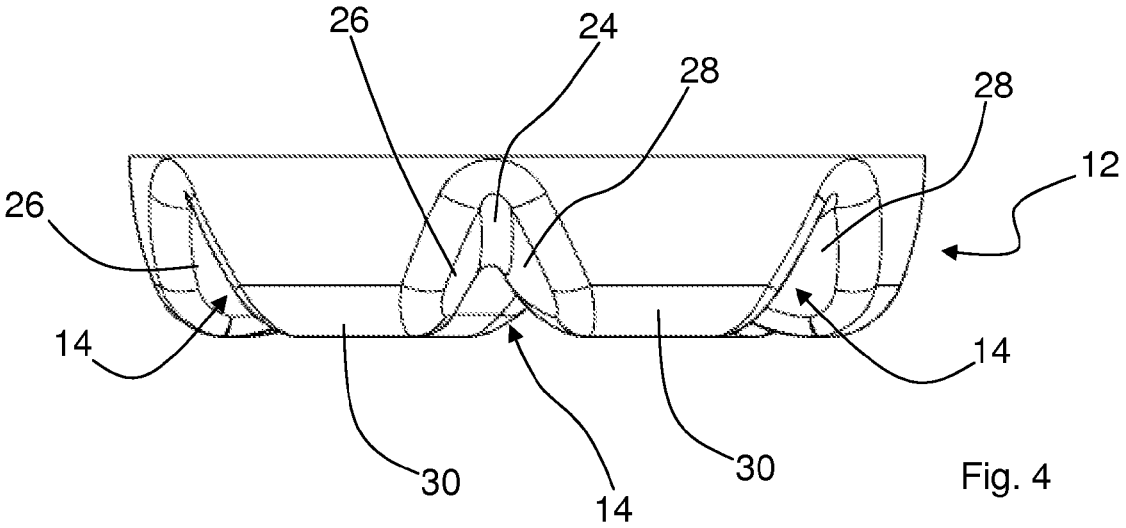
FIG. 4 shows a side view of the base of a bottle according to the present invention.
Figure 5:
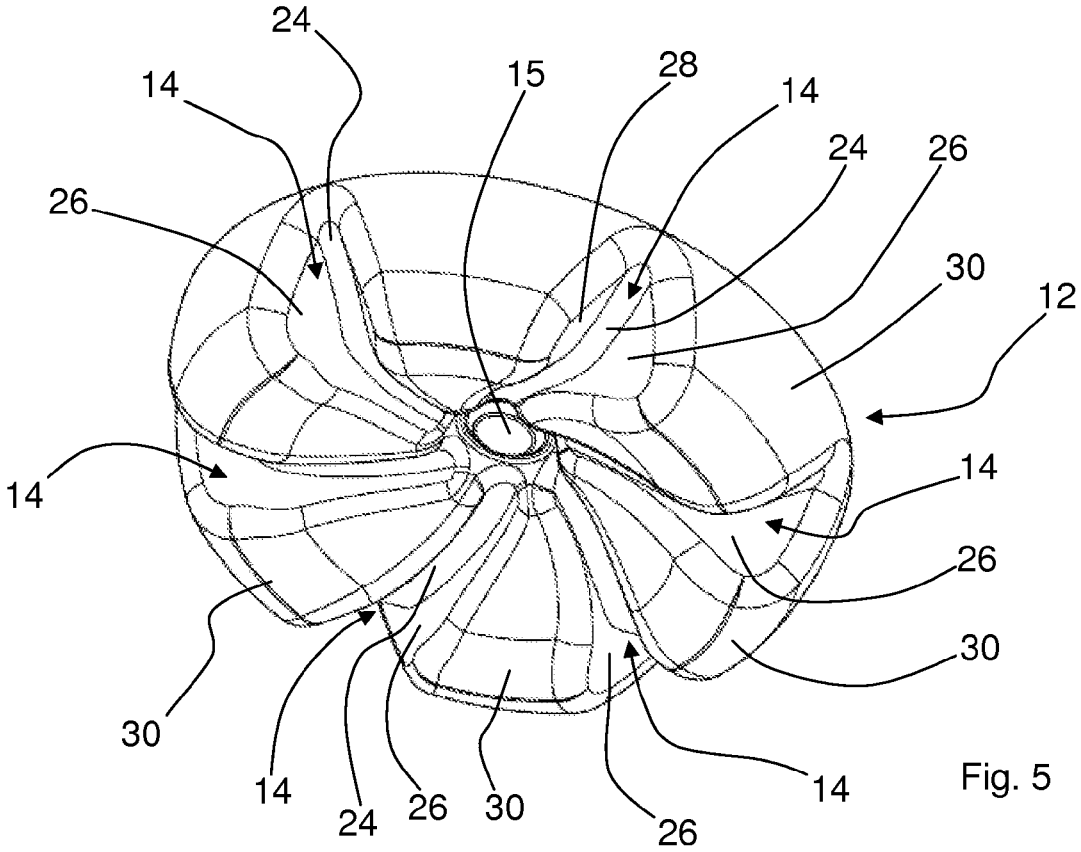
FIG. 5 shows a perspective view of the base of a bottle according to the present invention.

As can be clearly seen in FIG. 3, each rib 14 extends along a line of radial extension (indicated by the reference number 18 and shown as a dot-dash line). The bottle 10 according to the present invention is characterized in that the projection in a transverse plane of the line of radial extension 18 of at least one of said ribs 14 is curved.

Below the same reference number 18 is used to indicate the line of radial extension, the projection, in a transverse plane, of the line of radial extension and the projection, in a longitudinal plane, of the line of radial extension, since they consist of the same geometrical feature shown in different views.

According to one possible embodiment the base 12 of the bottle 10 comprises six ribs 14. Advantageously said ribs have a central symmetry.

In accordance with a first embodiment of the present invention the projection, in a transverse plane, of the line of radial extension 18 has at least one flexing point 20. Advantageously the projection, in a transverse plane, of the line of radial extension 18 has only one flexing point 20. The flexing point 20 may be advantageously provided at a distance d from the longitudinal axis of the bottle 16 equivalent to between 20% and 80% of the length of the external radius of the bottle.

Figures 10A, 10B, 10C:
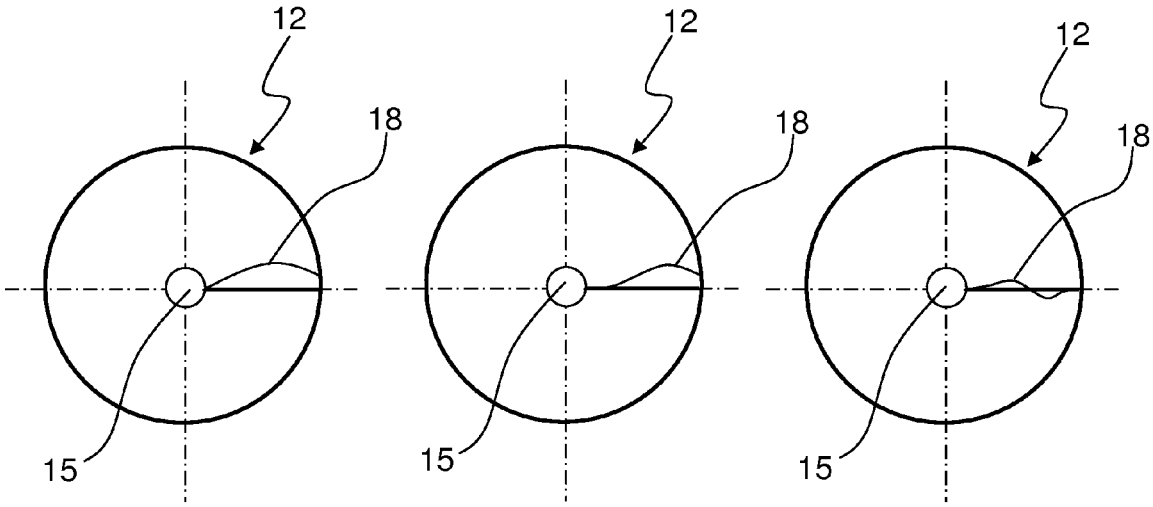
FIGS. 10A, 10B and 10C show three schematic views of three possible embodiments of a geometric form according to the present invention.

In accordance with alternative embodiments of the present invention, the projection, in a transverse plane, of the line of radial extension 18 does not have flexing points and therefore has only one curvature (see for example FIG. 10A). Alternatively, the projection, in a transverse plane, of the line of radial extension 18 may comprise a plurality of flexing points 20.

In accordance with a possible embodiment of the present invention, the projection, in a transverse plane, of the line of radial extension 18 is tangential to a straight line traced in the radial direction close to the longitudinal axis 16 of the bottle 10 (see for example FIG. 10B). In addition or as an alternative, the projection, in a transverse plane, of the line of radial extension 18 is tangential to a radial direction in the vicinity of the side surface 11 of the bottle 10 (see for example 10C).

The projection, in a transverse plane, of the line of radial extension 18 may be advantageously comprised within an angular segment having its vertex on the longitudinal axis 16 of the bottle 10 and having an angle at the centre of between 5° and 75°.

Each rib 14 may have a variable width along the line of radial extension 18. In accordance with a possible embodiment of the present invention, the rib 14 has a maximum amplitude in the vicinity of the outer surface 11 of the bottle 10 and has a minimum amplitude in the vicinity of the longitudinal axis 16.

With reference to FIGS. 4 to 8, the form of the projection, in a longitudinal plane, of the line of radial extension 18 will now be described. In accordance with a possible embodiment of the present invention, the projection, in a longitudinal plane, of the line of radial extension 18 is curved as can be clearly seen in FIG. 7.

Figure 6:
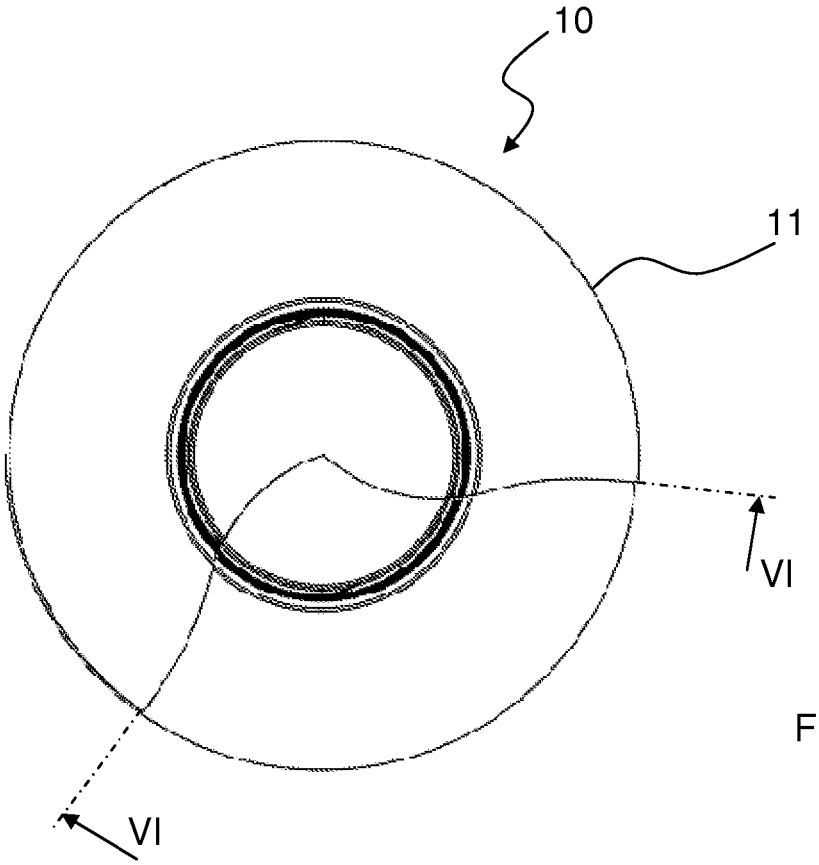
FIG. 6 shows a plan view, from above, of a bottle according to the present invention.
Figure 7:
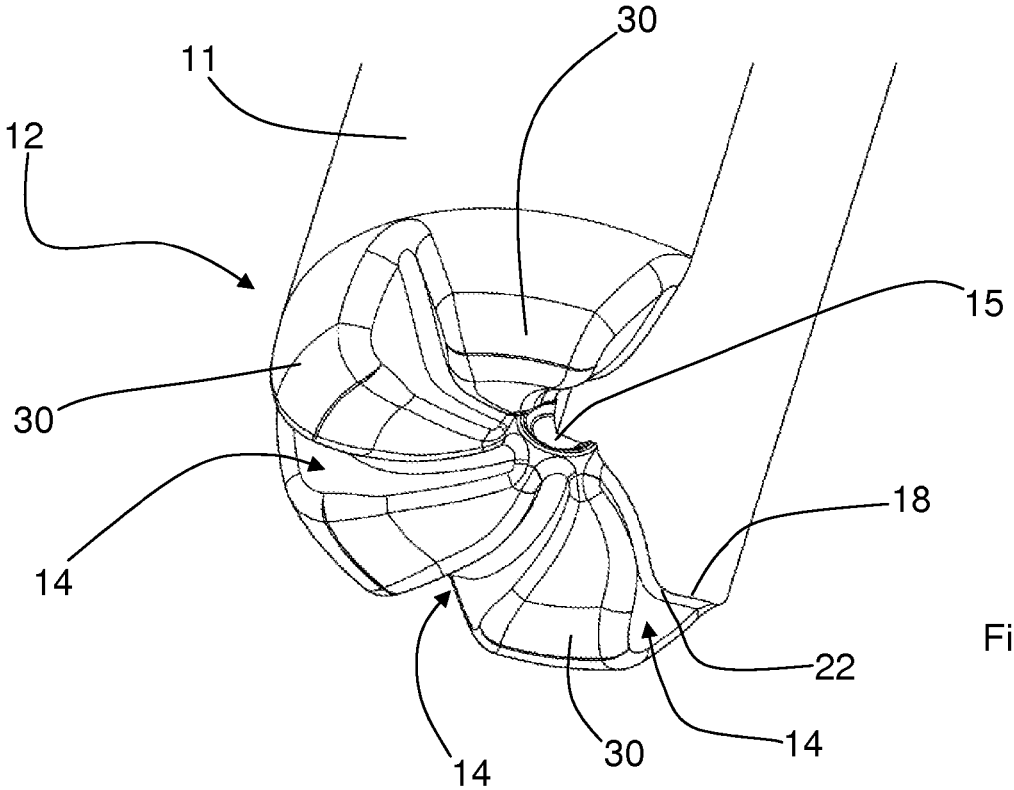
FIG. 7 shows a cross-sectional perspective view along a surface of cross-section VI-VI, shown in FIG. 5, of a bottle according to the present invention.
Figure 8:
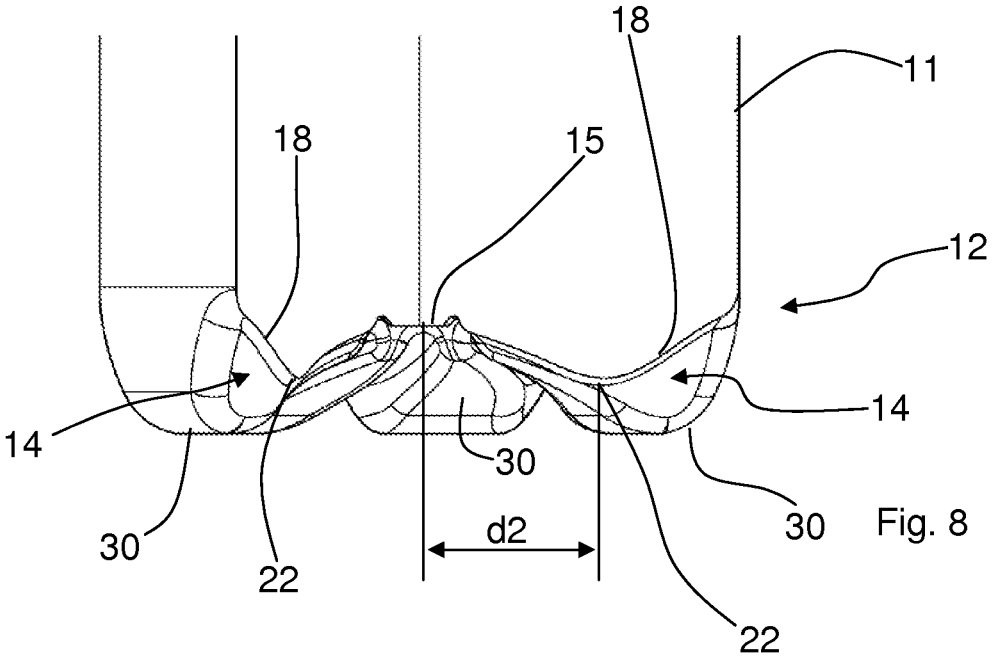
FIG. 8 shows a cross-sectional side view of a base of a bottle along the surface of cross-section VI-VI shown in FIG. 5.

FIGS. 7 and 8 have been obtained by sectioning the bottle along the curved cross-sectional surface indicated by VI-VI in FIG. 6. The surface has a longitudinal extension and comprises the projection, in a transverse plane, of a line of radial extension of a first rib 14, and the projection, in a transverse plane, of a line of radial extension of a second rib 14 not consecutive with the first rib.

In accordance with a possible embodiment of the present invention, the projection, in a longitudinal plane, of said line of radial extension 18 of said rib 14 is a straight line parallel or inclined with respect to a transverse plane. In accordance with an alternative embodiment of the present invention, the projection, in a longitudinal plane, of said line of radial extension 18 of said rib 14 is a curved line. Advantageously, the projection, in a longitudinal plane, of said line of radial extension 18 of said rib 14, is concave and this concavity is directed towards the inside of the bottle. Advantageously, the lowest point 22 of this concavity is situated at a distance from the longitudinal axis 16 of the bottle 10 equivalent to between 25% and 75% of the bottle radius.

The form of the ribs 14 according to the present invention will now be described in detail. With reference to FIG. 3, the rib according to the present invention comprises: a central portion 24 and two walls 26, 28 inclined in a V shape, with the central portion 24 arranged on the vertex of the V and directed towards the inside of the bottle. In accordance with a possible embodiment of the present invention, the central portion 24 extends in a plane. Advantageously, the central portion 24 may extend along a curved surface so as to form a connection between the two walls 26, 28.

In accordance with an alternative embodiment, the central portion 24 may be a connection between the walls 26, 28 which may be also not curved, in a manner known per se.

In accordance with a possible embodiment of the present invention, the connection between said central section 24, V-shaped walls 26, 28 and base 12 of the bottle 10 is performed with curved surfaces.

Advantageously, in the vicinity of the longitudinal axis 16 of the bottle 10 the ribs 14 are joined together on a sprue plug 15. The sprue plug 15 may have a circular form.

The particular form of the ribs 14 according to the present invention consequently generates a corresponding number of petals 30 between two consecutive ribs 14. The petals 30 project from the base 12 of the bottle 10 in the longitudinal direction towards the outside of the bottle 10. Advantageously the petals 30 have a rounded form which connects the curved surfaces to the adjacent ribs 14 and to the side surface 11 of the bottle 10.

The contact-surface diameter of the bottle 10 is provided on said petals 30. Advantageously, the contact-surface diameter of the base of the bottle is comprised between 50% and 95% of the bottle radius.

In accordance with a possible embodiment of the present invention, the sprue plug 15 is situated at a distance in the longitudinal direction from the contact-surface diameter of the bottle equivalent to between 5% and 45% of the bottle radius.

In accordance with a possible embodiment of the present invention, the ribs 14 are symmetrical with respect to their centre line, i.e. with respect to the line of radial extension 18.

In view of the form of the base described above, it can be noted that the cross-sections of maximum moment of inertia are distributed both in the radial direction and tangential direction. In fact, in the base described above, the resistance is in both directions (radial and tangential) and is thus improved, this reducing outward flexing of the base.

Figure 9:
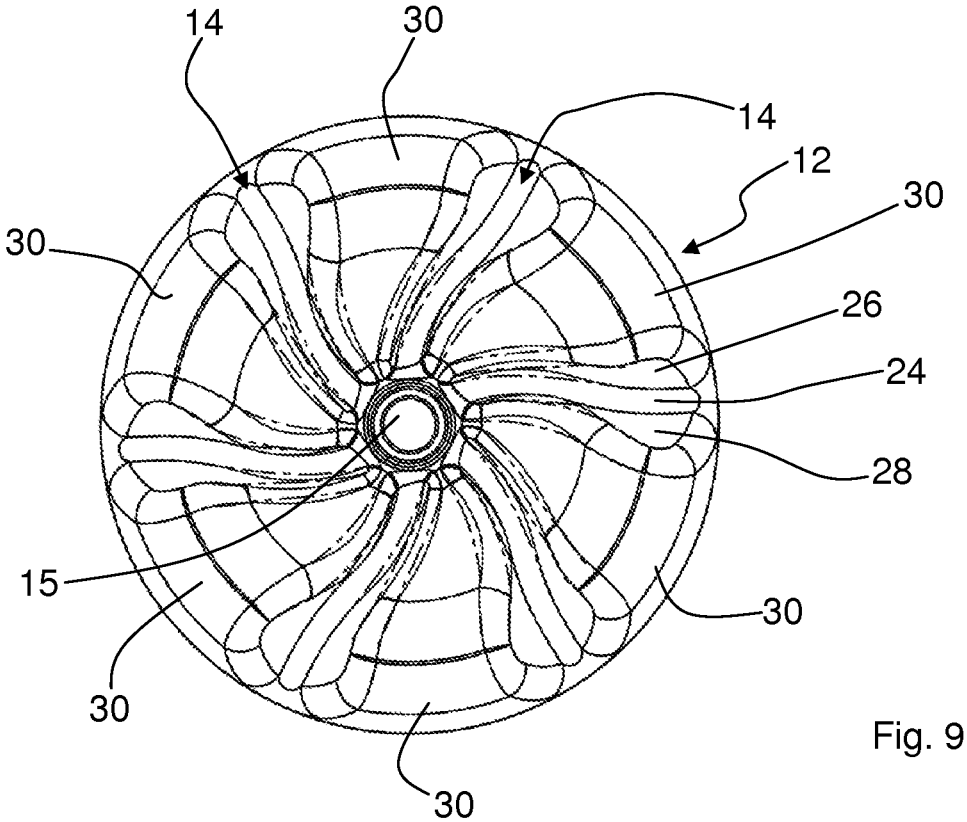
FIG. 9 shows a view, from below, of the base of a bottle according to the present invention in two different conditions of use.

As shown in FIG. 9, in view of the spiral form, the base 12 acts in the manner of a spiral spring which, stressed by an internal pressure of the bottle, tends to absorb the displacement due to the resultant force applied, rotating in the direction of unwinding of the spiral. The two operating conditions are shown in FIG. 9:

- the continuous lines show the configuration of the base 12 in the rest condition; and
- the broken lines show the configuration of the base 12 when the bottle has an internal pressure greater than the external pressure.

For the sake of illustration, the displacement of the ribs between the condition shown in continuous lines and that represented by the broken line may be shown accentuated compared to the situation in reality and in any case may not be visible to the naked eye.

It can be noted how the geometric form of the base tends advantageously to rotate until it assumes a straight configuration for counteracting the stress of the internal pressure. This slight movement tends to absorb the deformation in the tangential direction and not in the axial direction, thus reducing outward flexing of the base.

An example of the measurements of a bottle according to the present invention is now provided:

- external surface radius of the bottle: 33 mm
- height of bottle: 225 mm;
- distance of the flexing point 20 from the longitudinal axis of the bottle: 15 mm;
- amplitude of the angular segment containing the line of radial extension 18: 42°;
- lowest point 22 of the concavity of the projection in a longitudinal plane of said line of radial extension 18: 16 mm;
- contact-surface diameter: 58 mm; and
- distance of the sprue plug from the contact-surface diameter in the longitudinal direction: 6 mm.

With regard to the embodiments described above, the person skilled in the art may, in order to satisfy specific requirements, make modifications to and/or replace elements described with equivalent elements, without thereby departing from the scope of the accompanying claims.

For example, even though in the optimum embodiment, the base is provided with six ribs, satisfactory results would be obtained also with five or seven ribs.

Figure 11:
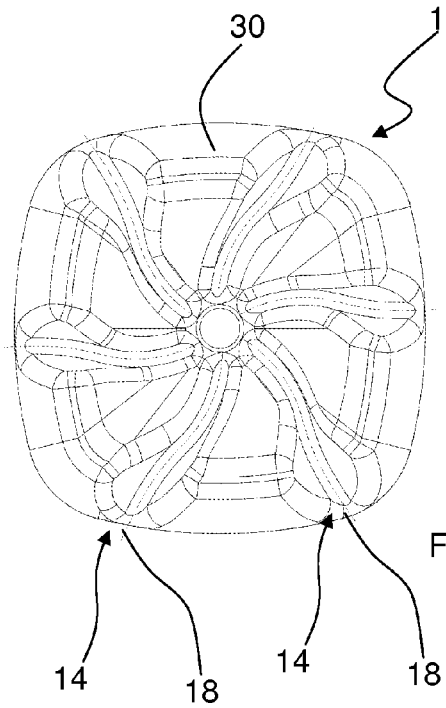
FIGS. 11 and 12 show two alternative embodiments of the present invention.
Figure 12:
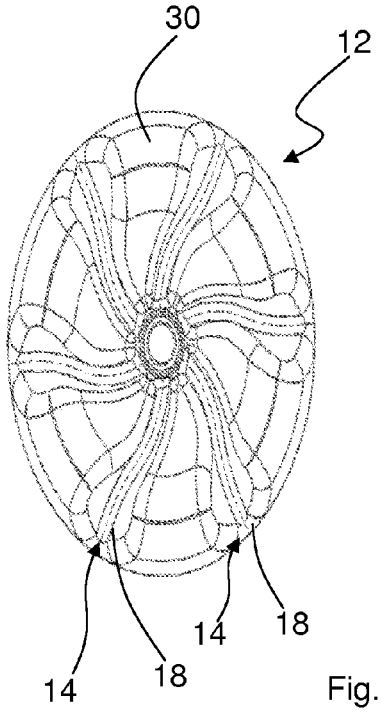

The principles of the present invention may be applied to bottles having a circular, square, elliptical or other cross-section. In the case of cross-sections of the bottle other than the circular form, for example square or elliptical cross-sections (see FIGS. 11 and 12, respectively), in order to apply the principles of the present invention described above, it is possible to identify a circumference inside which the form of the bottle base may be inscribed.

The bottle according to the present invention may be used for gasified or non-gasified liquids.

The invention claimed is:

1. A bottle made of polymer material comprising a base, and on said base a plurality of ribs being provided, each rib consisting of a curvature of the base of the bottle which forms a protuberance in a longitudinal direction directed towards an inside of the bottle;

said ribs extending in a radial direction along a line of radial extension;

wherein a projection, in a transverse plane, of said line of radial extension of at least one of said ribs is curved, the projection having at least one flexing point, and wherein curve of the projection of the at least one rib changes from being concave to being convex at the at least one flexing point.

2. The bottle of claim 1, wherein said flexing point is situated at a distance from a longitudinal axis of the bottle is between 20% and 80% of a radius of the bottle.

3. The bottle of claim 1, wherein said projection is tangential to a radial direction in a vicinity of a longitudinal axis of the bottle.

4. The bottle of claim 1, wherein said projection is tangential to a radial direction in a vicinity of a side surface of the bottle.

5. The bottle of claim 1, wherein said projection is contained within an angular segment having a vertex on a longitudinal axis of the bottle and having an angle at a center of between 5° and 75°.

6. The bottle of claim 1, wherein the projection, in a radial plane, of said line of radial extension of at least one of said ribs is curved.

7. The bottle of claim 6, wherein the projection, in the radial plane is concave, with concavity directed towards an inside of the bottle.

8. The bottle of claim 7, wherein the projection, in the radial plane is concave with a lowest point of said concavity situated at a distance from a longitudinal axis of the bottle equivalent to between 25% and 75% of a radius of the bottle.

9. The bottle of claim 1, wherein said at least one rib comprises a central section and two walls inclined in a V shape, with a vertex of the V directed towards an inside of the bottle.

10. The bottle of claim 9, wherein connection between the central section, inclined V-shaped walls and base of the bottle is performed with curved surfaces.

11. The bottle of claim 1, wherein a contact-surface diameter of the base of the bottle is between 50% and 95% of a radius of the bottle.

12. The bottle of claim 1, wherein said base comprises in a central position with a sprue plug situated at a distance in a longitudinal direction from a contact-surface diameter between 5% and 45% of a radius of the bottle.

* * * * *